US008715032B2

(12) United States Patent
Horikoshi et al.

(10) Patent No.: US 8,715,032 B2
(45) Date of Patent: May 6, 2014

(54) SPINNER FOR TOY TOP

(75) Inventors: Kenji Horikoshi, Tokyo (JP); Takeaki Maeda, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 327 days.

(21) Appl. No.: 13/184,145

(22) Filed: Jul. 15, 2011

(65) Prior Publication Data

US 2011/0306269 A1 Dec. 15, 2011

(30) Foreign Application Priority Data

Oct. 6, 2010 (JP) ..... 2010-6647

(51) Int. Cl.
*A63H 1/00* (2006.01)

(52) U.S. Cl.
USPC ..... 446/256; 446/259

(58) Field of Classification Search
USPC ..... 446/38, 39, 256–264; 74/29, 30, 422, 74/423, 421 A, 459.5; 192/56.1, 79; 464/37
See application file for complete search history.

(56) References Cited

U.S. PATENT DOCUMENTS

| | | | | |
|---|---|---|---|---|
| 214,154 | A | 4/1879 | Johnson | |
| 615,930 | A | 12/1898 | Warren | |
| 1,207,200 | A | 12/1916 | Novak | |
| 1,208,431 | A | 12/1916 | Wilcox | |
| 1,366,535 | A | 1/1921 | Harrington | |
| 1,668,695 | A | 5/1928 | Pfaff | |
| 1,771,489 | A | 7/1930 | Dochnal | |
| D161,581 | S | 1/1951 | Greene | |
| 2,561,601 | A | 7/1951 | Szonnell | |
| D199,259 | S | 9/1964 | Kramer et al. | |
| D199,536 | S | 11/1964 | Salayka | |
| 3,229,413 | A * | 1/1966 | Bross | 446/39 |
| 3,237,342 | A * | 3/1966 | Bross | 446/38 |
| D205,458 | S | 8/1966 | Bross | |
| D205,459 | S | 8/1966 | Bross | |

(Continued)

FOREIGN PATENT DOCUMENTS

| | | |
|---|---|---|
| CN | 2155919 | 2/1994 |
| CN | 1446607 | 10/2003 |

(Continued)

OTHER PUBLICATIONS

Espacenet English Abstract, Publication No. CN2155919, Dated Feb. 16, 1994.

(Continued)

*Primary Examiner* — Gene Kim
*Assistant Examiner* — Urszula M Cegielnik
(74) *Attorney, Agent, or Firm* — Staas & Halsey LLP

(57) ABSTRACT

A spinner for a toy top enables a launching position of a toy top to be easily set and held in place even when a rack belt is vigorously pulled out. The spinner includes an elongated rack belt having a rack gear, and a spinner main body formed with an insertion hole through which the rack belt is inserted. The spinner main body includes a toy top mounting part rotatably provided on one surface thereof. Inside the spinner main body, a rotating mechanism that is actuated by pulling out the rack belt to impart a rotational force to the toy top mounting part is provided. The rack belt can be inserted into and pulled out from the insertion hole in a same direction as an axis of rotation of the toy top mounting part.

34 Claims, 8 Drawing Sheets

(56) References Cited

U.S. PATENT DOCUMENTS

| | | | | |
|---|---|---|---|---|
| 3,352,055 | A | 11/1967 | Pelkowski | |
| D212,240 | S | 9/1968 | Wong | |
| 3,701,216 | A | 10/1972 | Smith, III et al. | |
| 3,732,645 | A * | 5/1973 | Winston | 446/38 |
| D246,197 | S | 10/1977 | Iwanami | |
| D263,858 | S | 4/1982 | Ngai | |
| D289,907 | S | 5/1987 | Redding | |
| D302,191 | S | 7/1989 | Lakin | |
| D302,446 | S | 7/1989 | Cheng | |
| 4,959,035 | A * | 9/1990 | Murasaki | 446/40 |
| D353,633 | S | 12/1994 | Nonaka et al. | |
| D364,898 | S | 12/1995 | Davidson | |
| 5,518,437 | A | 5/1996 | Nonaka et al. | |
| 5,525,086 | A * | 6/1996 | Gentile et al. | 446/41 |
| 5,593,338 | A * | 1/1997 | Itoh et al. | 446/259 |
| 5,601,491 | A * | 2/1997 | Chan et al. | 464/37 |
| 6,398,618 | B1 * | 6/2002 | Wu | 446/330 |
| 6,739,939 | B2 | 5/2004 | Matsukawa | |
| 6,743,070 | B1 | 6/2004 | Lin | |
| 6,769,953 | B1 * | 8/2004 | Sutton et al. | 446/256 |
| D502,968 | S | 3/2005 | Takahashi | |
| D503,439 | S | 3/2005 | Galletti | |
| 6,905,389 | B2 | 6/2005 | Matsukawa | |
| 6,923,409 | B2 * | 8/2005 | Strunk | 248/111 |
| 7,063,589 | B2 | 6/2006 | Matsukawa et al. | |
| 7,211,282 | B2 * | 5/2007 | Straus et al. | 426/91 |
| 7,220,160 | B2 | 5/2007 | Kiuchi | |
| D554,201 | S | 10/2007 | Vatuskey et al. | |
| 7,309,273 | B2 | 12/2007 | Ogihara | |
| D566,202 | S | 4/2008 | Sasada | |
| D577,084 | S | 9/2008 | Nakayama | |
| 7,427,225 | B2 * | 9/2008 | Matsukawa et al. | 446/256 |
| 7,481,691 | B2 | 1/2009 | Sze et al. | |
| 7,500,898 | B2 | 3/2009 | Laurienzo et al. | |
| D610,210 | S | 2/2010 | Nishimoto | |
| D610,211 | S | 2/2010 | Nishimoto | |
| D616,043 | S | 5/2010 | Ujita | |
| D637,661 | S | 5/2011 | Horikoshi | |
| 7,950,976 | B2 * | 5/2011 | Bernstein et al. | 446/429 |
| D639,349 | S | 6/2011 | Horikoshi | |
| 2002/0098768 | A1 | 7/2002 | Kuo et al. | |
| 2003/0064660 | A1 | 4/2003 | Matsukawa | |
| 2003/0228916 | A1 | 12/2003 | Simeray | |
| 2004/0198152 | A1 | 10/2004 | Matsukawa | |
| 2006/0014471 | A1 | 1/2006 | Yamaguchi et al. | |
| 2006/0099879 | A1 | 5/2006 | McGrath | |
| 2006/0099880 | A1 | 5/2006 | Lauienzo et al. | |
| 2008/0194173 | A1 | 8/2008 | Tiefel et al. | |
| 2009/0253345 | A1 | 10/2009 | Ujita et al. | |
| 2010/0159798 | A1 | 6/2010 | Bertrand et al. | |

FOREIGN PATENT DOCUMENTS

| | | | |
|---|---|---|---|
| CN | 2604212 | Y | 2/2004 |
| CN | 3446375 | | 5/2005 |
| CN | 2707340 | Y | 7/2005 |
| CN | 3506868 | | 2/2006 |
| CN | 3575984 | | 11/2006 |
| CN | 300839704 | | 10/2008 |
| CN | 300846725 | | 11/2008 |
| CN | 201186159 | Y | 1/2009 |
| CN | 300897376 | | 3/2009 |
| CN | 201279388 | Y | 7/2009 |
| CN | 301113361 | | 1/2010 |
| DE | 202 07 253 | | 10/2002 |
| DE | 20207253 | | 10/2002 |
| DE | 203 04 502 | | 7/2003 |
| EP | 000979612-0008 | | 9/2008 |
| EP | 2 133 128 | | 12/2009 |
| FR | 766329 | | 4/1934 |
| JP | 11-342274 | | 12/1999 |
| JP | 3067318 | | 1/2000 |
| JP | 3071356 | | 6/2000 |
| JP | 3077132 | | 2/2001 |
| JP | 1148754 | | 7/2002 |
| JP | 2003-103062 | | 4/2003 |
| JP | 3098449 | | 10/2003 |
| JP | 2003-320174 | | 11/2003 |
| JP | 1194145 | | 1/2004 |
| JP | 2005-328976 | | 12/2005 |
| JP | 3142475 | | 5/2008 |
| JP | 3160157 | | 5/2010 |
| JP | 3160658 | | 6/2010 |
| WO | 2007/011528 | | 1/2007 |

OTHER PUBLICATIONS

European Search Report in Appln. No. 11250649, dated Jan. 17, 2012.
Abstract of Japanese Publication No. 11342274, published Dec. 14, 1999.
Article appearing in Japanese Newspaper "Nihon Keizai Shimbun" (Japanese Economic Journal), Apr. 8, 2008, 3 pp.
Patent Abstract of China, Publication No. 1446607, Published Oct. 8, 2003.
Patent Abstract of China, Publication No. 201186159, Published Jan. 28, 2009.
Hong Kong Search Report in Application 10106692.6 dated Jul. 13, 2010.
U.S. Copyright Registration No. VA1-151-592 dated Nov. 15, 2002 with deposit copy.
U.S. Copyright Registration No. VA1-151-594 dated Nov. 15, 2002 with deposit copy.
U.S. Copyright Registration No. VA1-151-595 dated Nov. 15, 2002 with deposit copy.
U.S. Copyright Registration No. VA1-172-928 dated Oct. 22, 2002 with deposit copy.
U.S. Copyright Registration No. VA1-172-929 dated Oct. 22, 2002 with deposit copy.
U.S. Copyright Registration No. VA1-172-930 dated Oct. 22, 2002 with deposit copy.
U.S. Copyright Registration No. VA1-172-932 dated Oct. 22, 2002 with deposit copy.
U.S. Copyright Registration No. VA1-172-933 dated Oct. 22, 2002 with deposit copy.
U.S. Copyright Registration No. VA1-172-934 dated Oct. 22, 2002 with deposit copy.
U.S. Copyright Registration No. VA1-210-106 dated Oct. 17, 2003 with deposit copy.
U.S. Copyright Registration No. VA1-210-107 dated Oct. 17, 2003 with deposit copy.
U.S. Copyright Registration No. VA1-210-108 dated Oct. 17, 2003 with deposit copy.
U.S. Copyright Registration No. VA1-172-936 dated Oct. 22, 2002 with deposit copy.
Specimen filed in U.S. Trademark Registration No. 2,709,995 on Nov. 12, 2002.
Apr. 15, 2009 Office Action in Design U.S. Appl. No. 29/309,767 (Now USP D610,211).
Notice of Allowance issued Oct. 2, 2009 in Design U.S. Appl. No. 29/309,767 (Now USP D610,211).
Apr. 16, 2009 Office Action in Design U.S. Appl. No. 29/309,765 (Now USP D610,210).
Notice of Allowance issued Oct. 2, 2009 in Design U.S. Appl. No. 29/309,765 (Now USP D610,210).
Notice of Allowance issued Jan. 28, 2011 in Design U.S. Appl. No. 29/376,306.
Dec. 3, 2010 Office Action in U.S. Appl. No. 12/285,880.
Notice of Allowance issued Jan. 28, 2011 in Design U.S. Appl. No. 29/376,310.
European Search Report dated Jul. 31, 2009 in Application No. 08253249.0.
U.S. Appl. No. 12/895,283, filed Sep. 30, 2010, Horikoshi et al., Tomy Co., Ltd.
U.S. Appl. No. 12/926,184, filed Oct. 29, 2010, Ujita et al., Tomy Co., Ltd.

* cited by examiner

SPINNER FOR TOY TOP

CROSS-REFERENCE TO RELATED APPLICATIONS

This application claims the benefit under 35 U.S.C. §119 of Japanese Utility Model Application No. 2010-6647 filed on Oct. 6, 2010, which is hereby incorporated by reference in its entirety in this application.

BACKGROUND OF THE INVENTION

1. Field of the Invention

The present invention relates to a spinner for a toy top, and in particular, to a spinner for a toy top for launching a toy top while imparting a rotational force to the toy top by inserting a rack belt therein and pulling it out therefrom.

2. Description of the Related Art

Conventionally, a spinner for a toy top which launches a toy top through an operation of pulling out a rack belt has been known.

For example, Japanese Utility Model Registration No. 3160658, corresponding to U.S. Ser. No. 12/895,283 filed Sep. 30, 2010, discloses a spinner for a toy top which is so constructed that after a toy top is mounted on a toy top mounting part of a spinner main body, a rack belt is inserted into the spinner main body and, when the rack belt is vigorously pulled out, a driving mechanism inside the spinner main body is activated to rotate the toy top mounting part, to thereby launch the toy top which has a rotational force imparted thereto.

SUMMARY OF THE INVENTION

However, since users of such a spinner for a toy top are mainly children, it is difficult for them to fixedly hold a spinner main body. Accordingly, when the rack belt is vigorously pulled out, the spinner main body undesirably moves, thereby disadvantageously making it impossible to set and hold in place a launching position of the toy top.

The present invention has been made in view of the above problem. Accordingly, an object of the present invention is to provide a spinner for a toy top which enables a launching position of the toy top to be easily set and held in place even when the rack belt is vigorously pulled out.

In order to solve the above problem, according to the present invention, a spinner for a toy top for launching the toy top while imparting a rotational force to the toy top is provided. The spinner includes: an elongated plate-shaped rack belt having a rack gear formed thereon; and a spinner main body having an insertion hole formed therein through which the rack belt is inserted, the spinner main body including a toy top mounting part rotatably provided on a lower surface side thereof for mounting the toy top thereon and a rotating mechanism provided inside thereof, the rotating mechanism being actuated by pulling out the rack belt to impart a rotational force to the toy top mounting part, wherein the spinner main body is so constructed that the rack belt can be inserted in and pulled out from the insertion hole in a direction the same as a direction of an axis of rotation of the toy top mounting part.

In a preferred embodiment of the present invention, the spinner main body includes a base section in which the toy top mounting part is arranged and a rotary section rotatably provided with respect to the base section, and the insertion hole is formed in the rotary section so that a direction in which the insertion hole extends can be changed by rotating the rotary section with respect to the base section.

In a preferred embodiment of the present invention, the rotary section can be rotated at least 180 degrees from a state where the direction in which the insertion hole extends is orthogonal to a direction of the axis of rotation of the toy top mounting part.

In a preferred embodiment of the present invention, the rotating mechanism includes a pinion gear that meshes with the rack gear of the rack belt and that is rotated about a first axis of rotation by pulling out the rack belt, and a gear mechanism that transmits a rotation of the pinion gear to the toy top mounting part to rotate the toy top mounting part about a second axis of rotation orthogonal to the first axis of rotation.

In a preferred embodiment of the present invention, the gear mechanism includes a first bevel gear that is coupled to the pinion gear and that is integrally rotatable with the pinion gear about the first axis of rotation, and a second bevel gear that meshes with the first bevel gear and that is coupled to the toy top mounting part so as to rotate integrally with the toy top mounting part about the second axis of rotation.

In a preferred embodiment of the present invention, the rotary section has a rotational center that coincides with the first axis of rotation.

In a preferred embodiment of the present invention, the pinion gear is arranged inside the rotary section, and the first bevel gear and the second bevel gear are arranged inside the base section.

In a preferred embodiment of the present invention, the rotating mechanism includes a ratchet gear that is coupled to the pinion gear and that is integrally rotatable with the pinion gear about the first axis of rotation, and a lock member engaging with the ratchet gear to regulate a rotation of the ratchet gear, the lock member being pushed away by the rack belt inserted through the insertion hole to be disengaged from the ratchet gear.

According to the present invention, the rack belt can be inserted and pulled out in the same direction as that of the axis of rotation of the toy top mounting part. Therefore, even when the rack belt is vigorously pulled out to undesirably move the spinner main body, the launching position of the toy top can be easily set and held in place. The reason for this is that when the rack belt is pulled out, the spinner main body is moved in a direction reverse to the direction of pulling out the rack belt. In using the spinner of the present invention, when the rack belt is pulled out, even if the spinner main body is moved in a direction reverse to the direction of pulling out the rack belt, the moving direction of the spinner main body is the same direction as that of the axis of rotation of the toy top (that is, a vertical direction). Therefore, the launching position of the toy top in a horizontal direction with respect to a playing surface or ground on which the toy top is rotated is not influenced, and thus the launching position of the toy top can be easily set and held in place.

According to one embodiment of the present invention, the direction in which the insertion hole extends can be changed by rotating the rotary section with respect to the base section. Therefore, the direction of inserting and pulling out the rack belt can be set as desired, and the rack belt can be pulled out in a direction in which the user can easily perform a pulling operation.

According to one embodiment of the present invention, the rotary section is provided so as to be rotatable at least 180 degrees from the state where the direction in which the insertion hole extends is orthogonal to the axis of rotation of the toy top mounting part. That is, as long as the top launching device is held so that the axis of rotation of the toy top is properly in a vertical direction, the direction of inserting and pulling out the rack belt can be either a vertical direction or a horizontal direction. Therefore it is a matter of course that the rack belt can be pulled out in the vertically upward direction. Furthermore, the rack belt can be inserted and pulled out even when the device is held while the base section is positioned on either the right or left side of the rotary section. Thus the spinner of the present invention is suitable for both right-handed and left-handed players.

DESCRIPTION OF THE EMBODIMENTS

Figure 1:
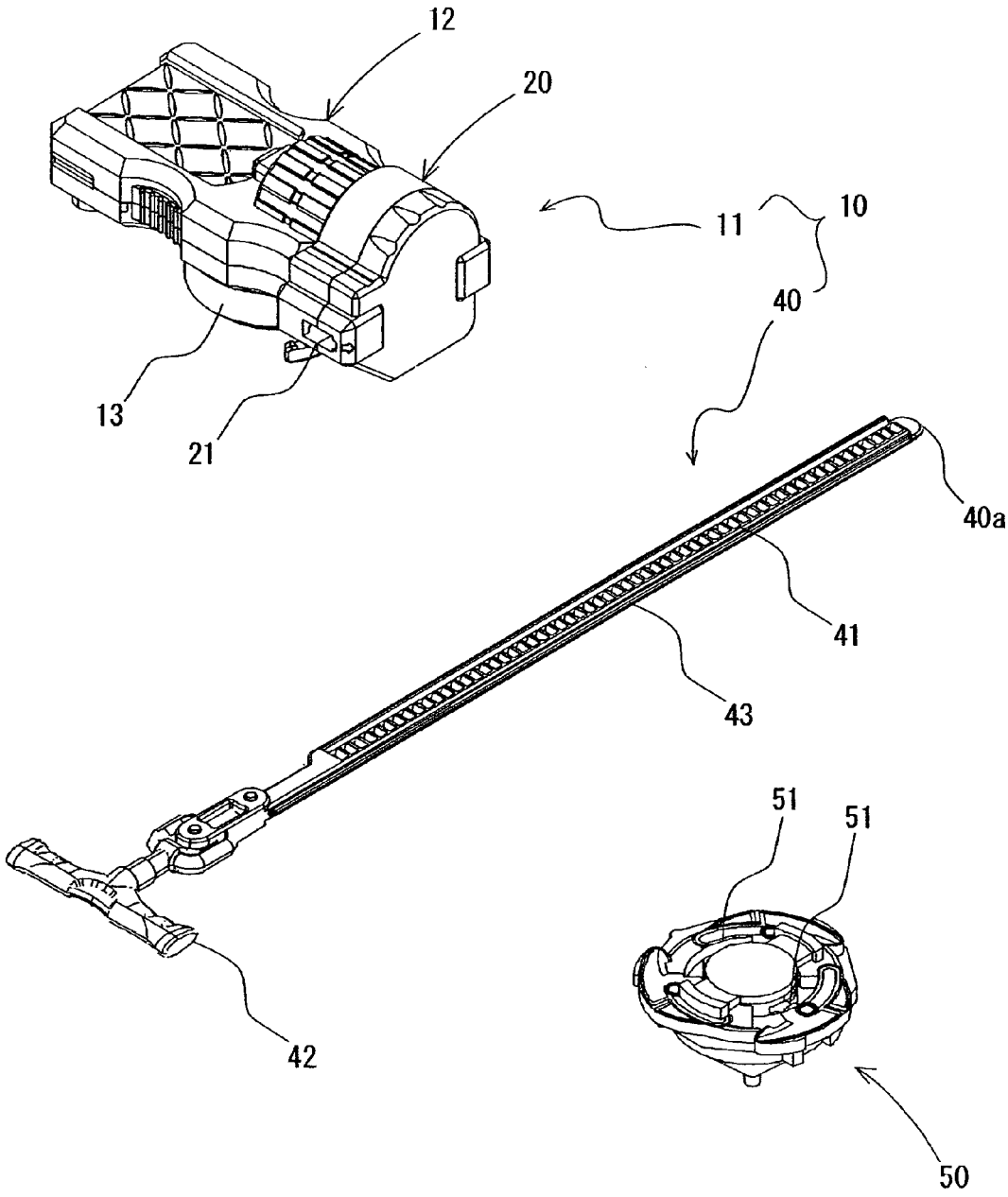
FIG. 1 is a perspective view showing a spinner for a toy top according to an embodiment of the present invention, together with a toy top.

A spinner for a toy top according to an embodiment of the present invention is described with reference to the drawings. A spinner 10 for a toy top according to the present embodiment is constructed to launch a toy top 50 while imparting a rotational force to the toy top 50, and includes, as shown in FIG. 1, a rack belt 40 and a spinner main body 11 that has a rotating mechanism 30 operable therein, which will be described further below. The spinner main body 11 has an insertion hole 21 formed therein through which the rack belt 40 is inserted. In this spinner 10, as shown in FIGS. 2A and 2B, the rack belt 40 is inserted through the insertion hole 21 formed in the spinner main body 11 and then the rack belt 40 is quickly pulled out, so that the rotating mechanism 30 provided in the spinner main body 11 can be actuated to impart a rotational force to the toy top 50.

Figure 2A:
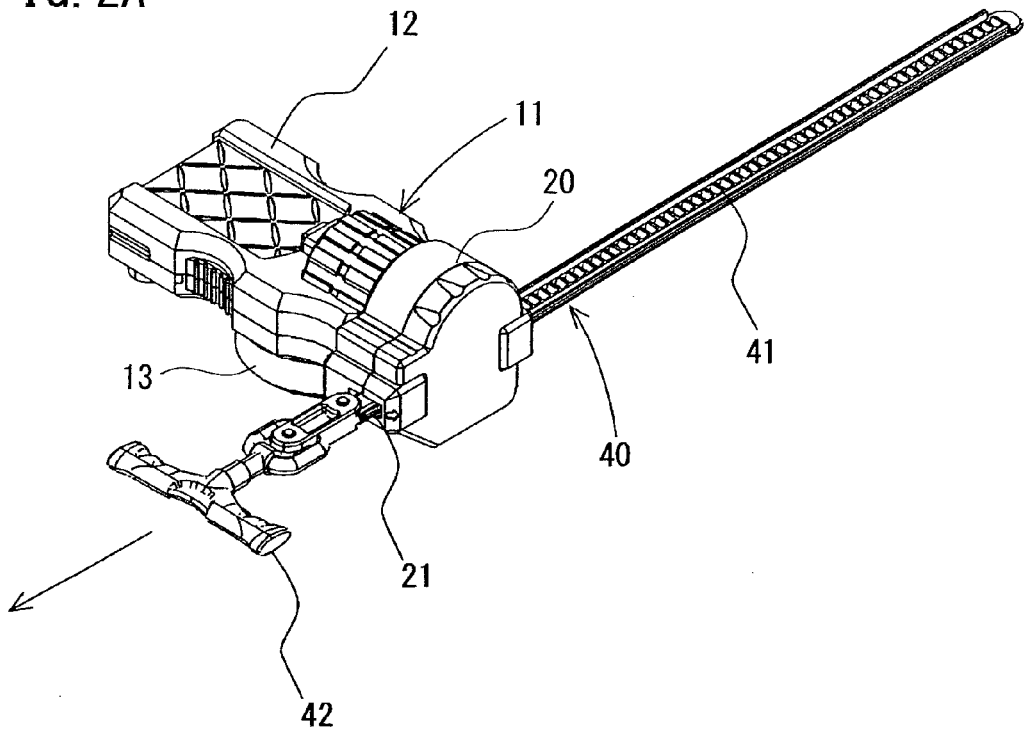
FIGS. 2A and 2B are perspective views showing the state in which a rack belt is pulled out from a spinner main body of the spinner.
Figure 2B:
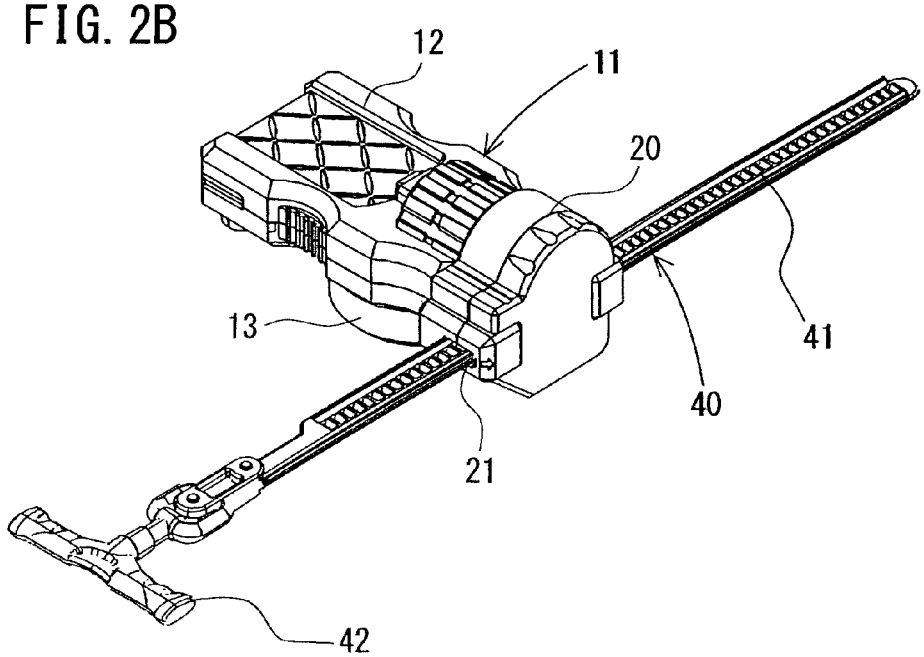

As shown in FIGS. 1, 2A and 2B, the rack belt 40 has teeth of a rack gear 41 formed on a surface thereof to protrude like saw teeth. When the rack belt 40 is inserted through the insertion hole 21 of the spinner main body 11, the rack gear 41 meshes with a pinion gear 32, which constitutes the rotating mechanism 30 and will be described further below. When the rack belt 40 is pulled out, the rotating mechanism 30 in the spinner main body 11 is actuated. The rack belt 40 has a handle 42 attached to a base end thereof so as to facilitate a pulling-out operation.

Figure 3A:
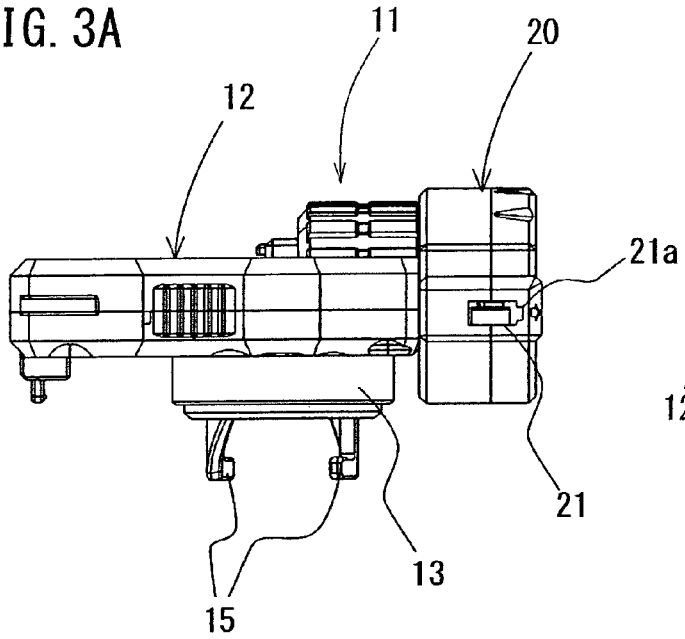
FIGS. 3A, 3B and 3C are a front view, a side view and a bottom view, respectively, of the spinner main body.
Figure 3B:
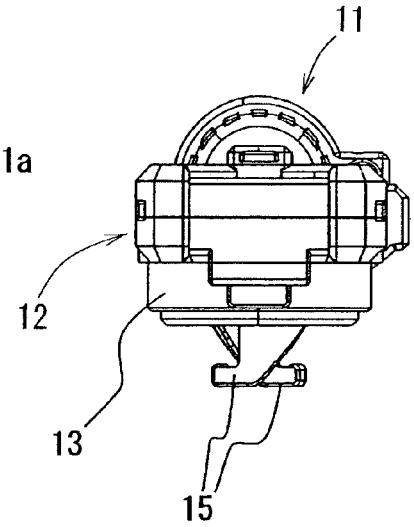
Figure 3C:
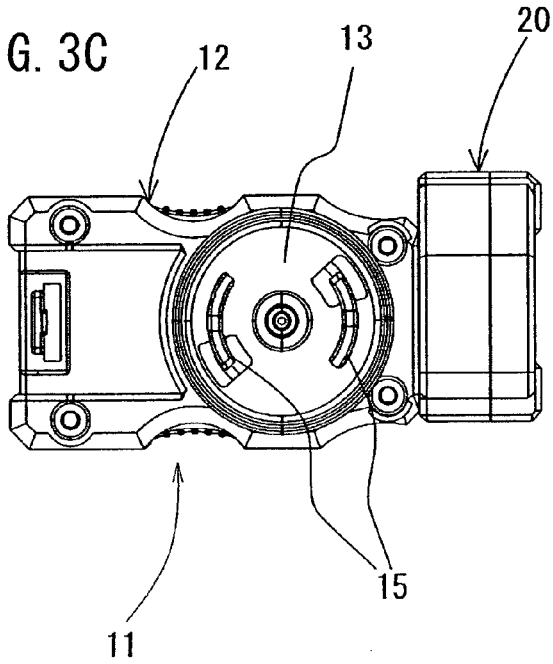

As shown in FIGS. 3A to 3C, the spinner main body 11 includes a base section 12 and a rotary section 20. The base section 12 and the rotary section 20 are rotatably coupled together so as to have respective sides facing each other.

On a lower surface side of the base section 12, a toy top mounting part 13 on which the toy top 50 is mounted is rotatably provided. As shown in FIGS. 3A to 3C, the toy top mounting part 13 includes a cylindrical portion with a closed bottom and two engaging claws 15 protruding from a lower surface of the closed bottom. The two engaging claws 15 are disposed at two positions along a circumferential direction so that the engaging claws 15 can be engaged with respective engaging holes 51 (see FIG. 1) formed on an upper surface of the toy top 50. Thus, upon the engaging claws 15 being engaged with the engaging holes 51 of the toy top 50, the toy top 50 can be mounted on the toy top mounting part 13.

Figure 4A:
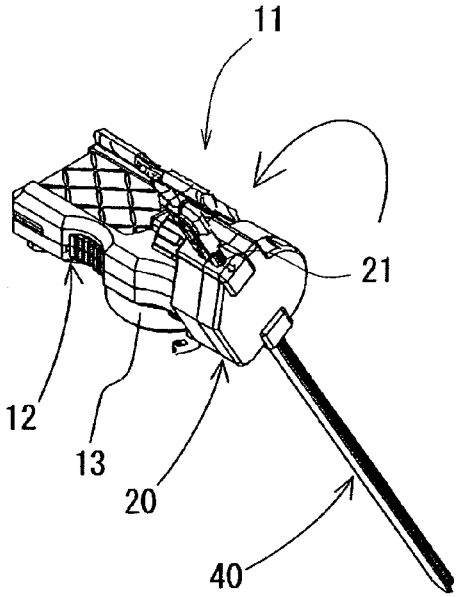
FIGS. 4A and 4B are illustrations showing the state in which a rotary section of the spinner main body rotates.
Figure 4B:
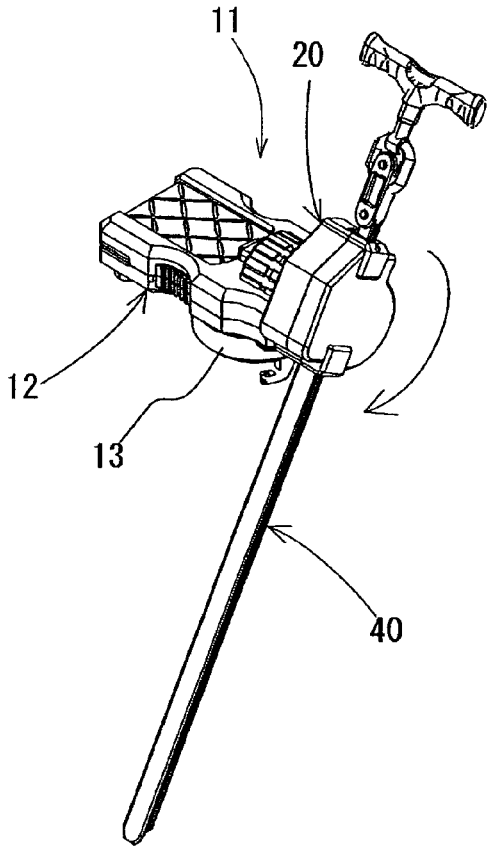

The rotary section 20 has the insertion hole 21 formed therein and, as described above, is rotatably coupled to the side of the base section 12. Accordingly, upon the rotary section 20 being rotated with respect to the base section 12, the direction in which the insertion hole 21 extends can be changed. When the direction in which the insertion hole 21 extends is changed in this manner, as shown in FIGS. 4A and 4B, the direction of inserting and pulling out the rack belt 40 can also be changed.

The insertion hole 21 of the rotary section 20 has a notch 21*a* formed in an inner side surface thereof so as to prevent the rack belt 40 from being inserted with a wrong orientation, i.e. its front and back reversed. On the other hand, the rack belt 40 has a linear protrusion 43 (see FIG. 1) formed on a side thereof so as to fit in the notch 21*a*. The rack belt 40 cannot be inserted in the insertion hole 21 unless the linear protrusion 43 and the notch 21*a* are aligned with each other. Upon this alignment being made, the rack belt 40 can be inserted in the insertion hole 21 with a correct orientation. Therefore, when the rack belt 40 is inserted in the insertion hole 21, the rack gear 41 of the rack belt 40 faces and meshes with the pinion gear 32 without failure.

In the spinner 10 according to the present embodiment, the rotary section 20 is arranged so as to rotate approximately 180 degrees and, in particular, is provided so as to rotate approximately 180 degrees from the state in which the extending direction of the insertion hole 21 is orthogonal to an axis of rotation of the toy top mounting part 13.

Figure 5A:
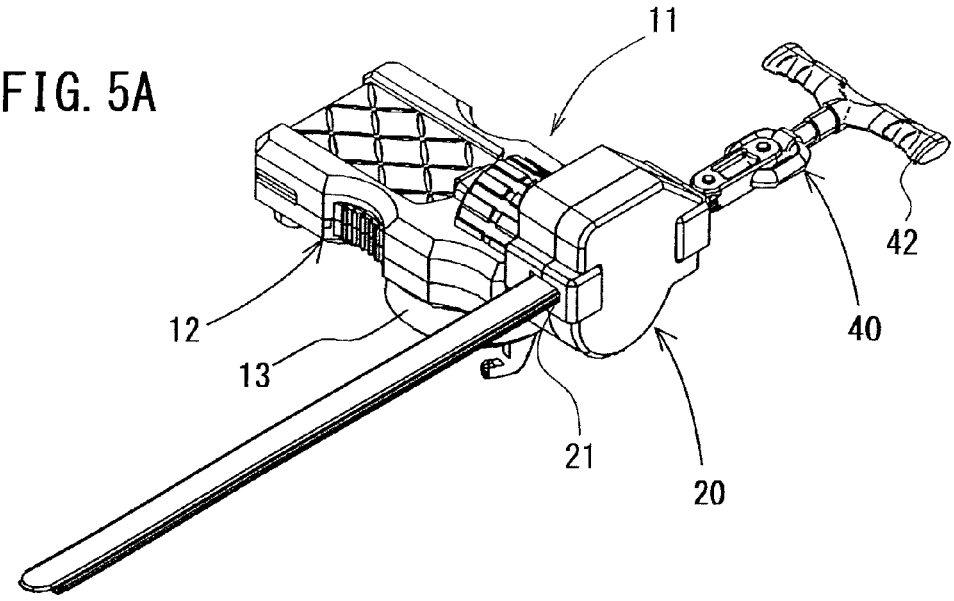
FIGS. 5A and 5B are illustrations showing the rotary section of the spinner main body that is rotated 180 degrees and 90 degrees, respectively, from the state shown in FIG. 2A.
Figure 5B:
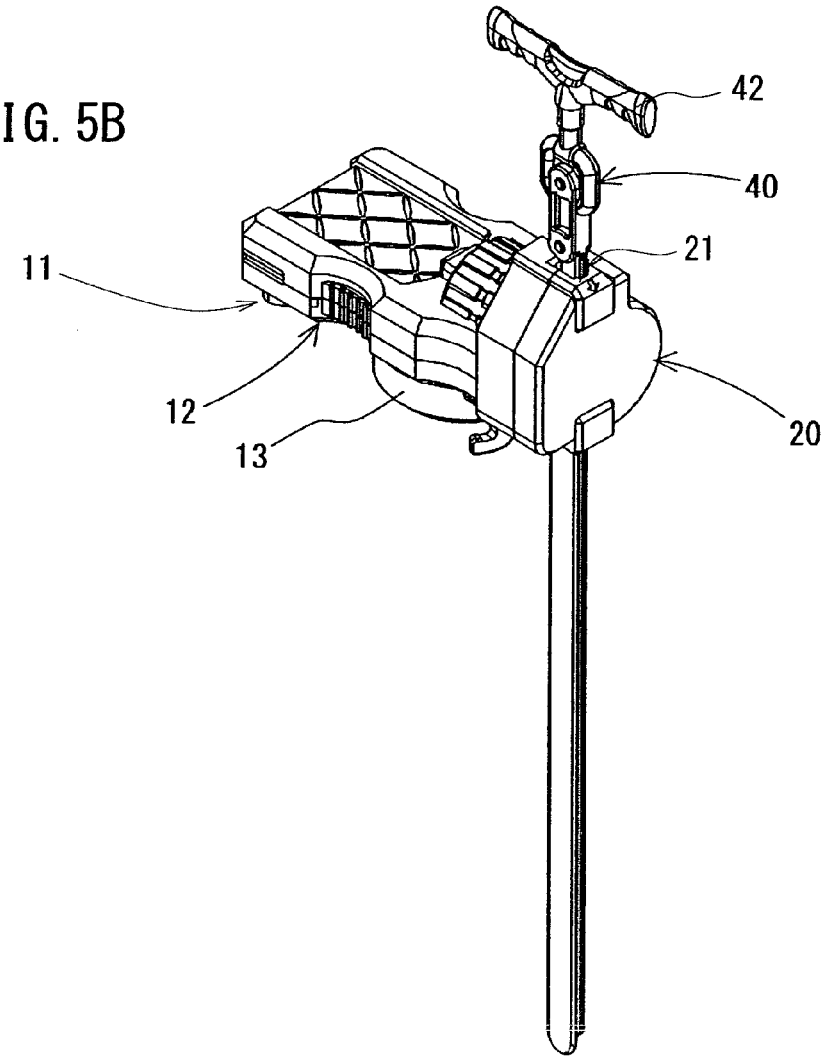

Herein, the wording "the state in which the extending direction of the insertion hole 21 is orthogonal to an axis of rotation of the toy top mounting part 13" means a state in which the inserting and pulling-out direction of the rack belt 40 is horizontal when the spinner 10 is held in such a manner that the axis of rotation of the toy top 50 (i.e., the axis of rotation of the toy top mounting part 13) is properly vertical, such as in a state shown in FIG. 2A. When the rotary section 20 is rotated 180 degrees from this state with respect to the base section 12, the inserting and pulling-out direction of the rack belt 40 can be reversed as shown in FIG. 5A. Also, in the course of rotation of the rotary section 20 from the state shown in FIG. 2A to the state shown in FIG. 5A, an intermediate state can be attained in which the inserting and pulling-out direction of the rack belt 40 is a vertical direction as shown in FIG. 5B.

As described above, the rotating mechanism 30 that imparts a rotational force to the toy top mounting part 13 by means of the rack belt 40 being inserted and pulled out is provided inside the spinner main body 11.

Figure 6:
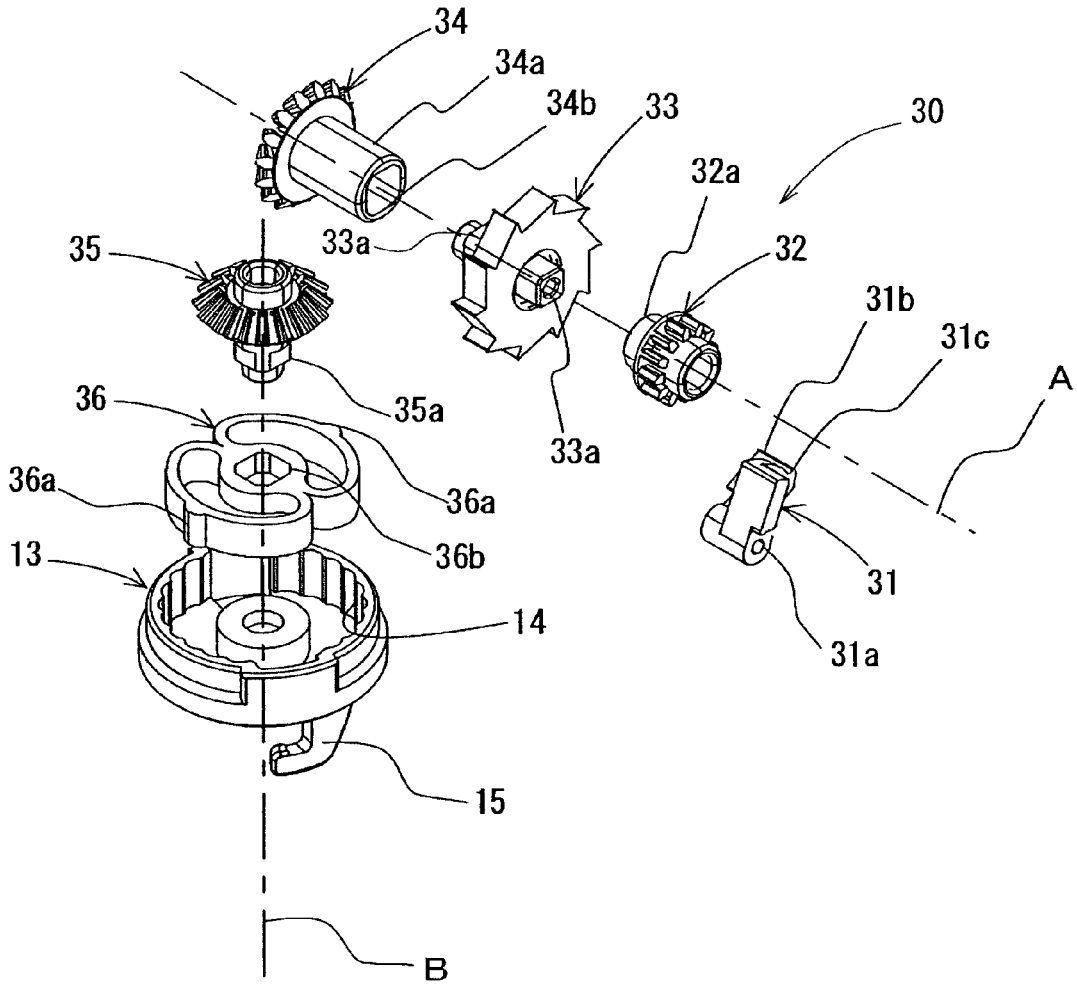
FIG. 6 is an exploded perspective view showing members constituting a rotating mechanism of the spinner main body.

As shown in FIG. 6, the rotating mechanism 30 includes a lock member 31, the pinion gear 32, a ratchet gear 33, a first bevel gear 34, a second bevel gear 35 and a clutch 36. In the rotating mechanism 30, the pinion gear 32 meshing with the rack gear 41 of the rack belt 40 is rotated by pulling out the rack belt 40. The rotational force of the pinion gear 32 is transmitted to the ratchet gear 33, the first bevel gear 34, the second bevel gear 35 and the clutch 36 in sequence, and then finally to the toy top mounting part 13, to thereby rotate the toy top mounting part 13.

In the rotating mechanism 30, the pinion gear 32, the ratchet gear 33 and the first bevel gear 34 are arranged so that their axes of rotation are identical, i.e. a common axis A. Among these members, the pinion gear 32 and the ratchet gear 33 are disposed inside the rotary section 20, whereas the first bevel gear 34 is disposed inside the base section 12. The common axis of rotation A of the members 32, 33 and 34 of the rotating mechanism 30 coincides with the rotational center of the rotary section 20. This arrangement prevents the axes of rotation of the pinion gear 32, the ratchet gear 33 and the first bevel gear 34 from being shifted even when the rotary section 20 is rotated with respect to the base section 12.

Also, the second bevel gear 35, the clutch 36 and the toy top mounting part 13 are arranged so that their axes of rotation are identical, i.e. a common axis B, and they are accommodated in the base section 12. The common axis of rotation B of the members 35, 36 and 13 is arranged to be orthogonal to the common axis of rotation A of the pinion gear 32 and the ratchet gear 33 provided in the rotary section 20 and the first bevel gear 34 provided in the base section 12, so that the rotary section 20 can be rotated with respect to the base section 12 while the axis of rotation A of the members 32 and 33 in the rotary section 20 and the first bevel gear 34 and the axis of rotation B of the members 35, 36 and 13 (except the first bevel gear 34) in the base section 12 are kept orthogonal to each other.

Figure 7:
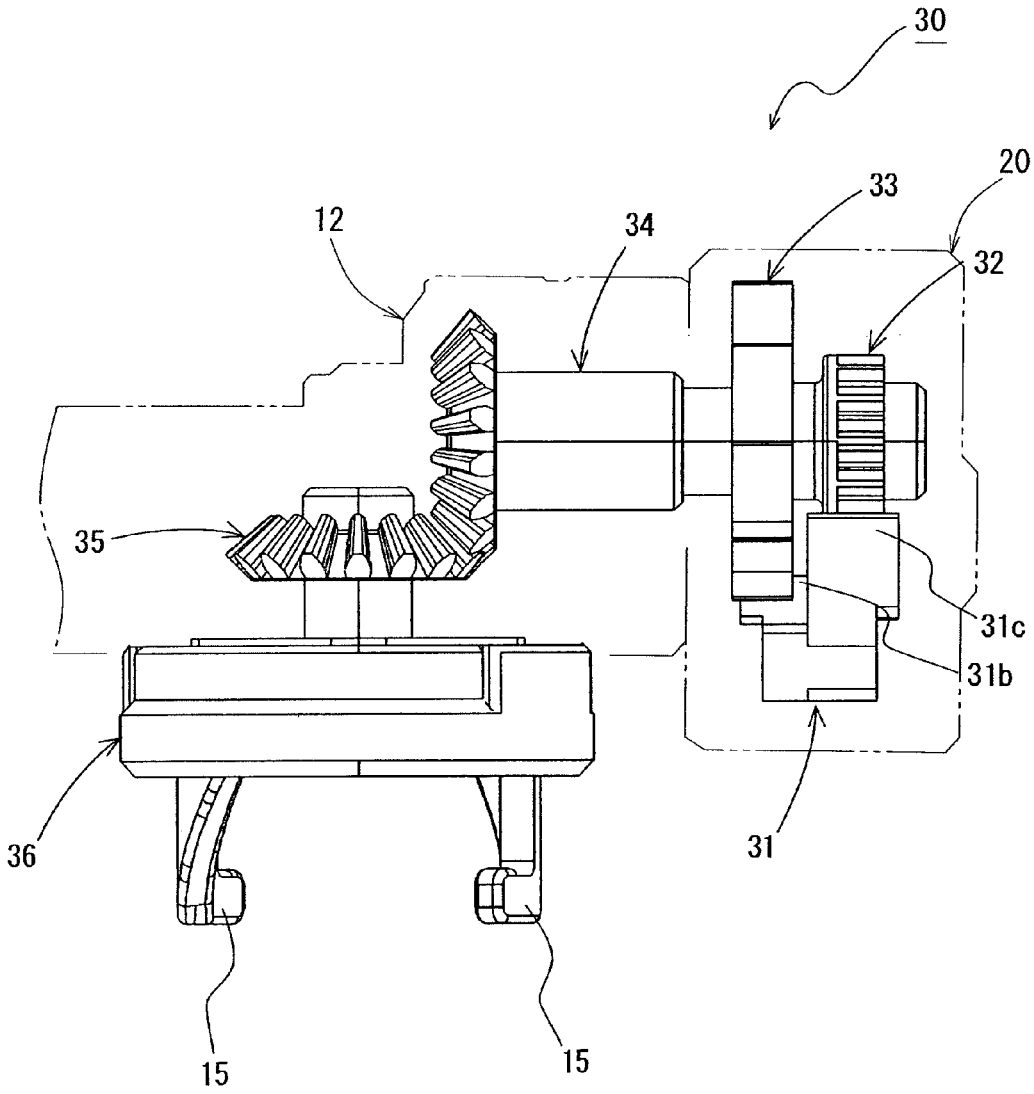
FIG. 7 is an elevation view of the rotating mechanism of the spinner main body.

Each of the members constituting the rotating mechanism 30 is described in detail below. The lock member 31 regulates the rotation of the ratchet gear 33, and is rotatably fixed to the rotary section 20 via a hole 31*a* and a pivot (not shown). As shown in FIGS. 6 and 7, the lock member 31 includes a ratchet pawl 31*b* and a belt contacting part 31*c* that extend in the respective directions of the ratchet gear 33 and the pinion gear 32. The ratchet pawl 31*b* is urged in the direction of the ratchet gear 33 by a biasing means (not shown), such as a spring, so as to engage with the ratchet gear 33 when the rack belt 40 is not inserted through the insertion hole 21.

When the rack belt 40 inserted through the insertion hole 21 of the spinner main body 11 is pulled out, the pinion gear 32 that meshes with the rack gear 41 of the rack belt 40 is rotated. The ratchet gear 33 is arranged on the same axis as that of the pinion gear 32 so as to stop the rotation of the entire rotating mechanism 30 by the engagement of the ratchet pawl 31*b* of the lock member 31 with the ratchet gear 33. As shown in FIG. 6, the ratchet gear 33 includes a square shaft part 33*a*. The shaft part 33*a* is inserted in a square hole (not shown) provided in a shaft part 32*a* of the pinion gear 32 so that the ratchet gear 33 rotates integrally with the pinion gear 32.

The first bevel gear 34 is arranged on the same axis as that of the pinion gear 32 and the ratchet gear 33 and meshes with the second bevel gear 35 described below so as to transmit a rotational force of the pinion gear 32 in a direction orthogonal to its axis of rotation. As shown in FIG. 6, the first bevel gear 34 has a rectangular hole 34*b* formed in a shaft part 34*a* thereof in an axial direction. The square shaft part 33*a* of the ratchet gear 33 is inserted in the square hole 34*b* so that the first bevel gear 34 rotates integrally with the pinion gear 32 and the ratchet gear 33.

The second bevel gear 35 meshes with the first bevel gear 34 described above, and has an axis of rotation orthogonal to the axis of rotation A of the pinion gear 32, the ratchet gear 33 and the first bevel gear 34.

The clutch 36 is fitted in the toy top mounting part 13, and has engaging protrusions 36*a* formed on an outer perimeter thereof, as shown in FIG. 6. Each of the engaging protrusions 36*a* is fitted in a respective one of vertical grooves 14 formed on an inner perimeter of the toy top mounting part 13 so that the clutch 36 rotates integrally with the toy top mounting part 13. The clutch 36 is provided with a square hole 36*b* at the center thereof. A square shaft part 35*a* of the second bevel gear 35 is inserted in the square hole 36*b* so that the clutch 36 can rotate about the same axis as that of the second bevel gear 35. Thus the second bevel gear 35, the clutch 36 and the toy top mounting part 13 rotate integrally.

Figure 8A:
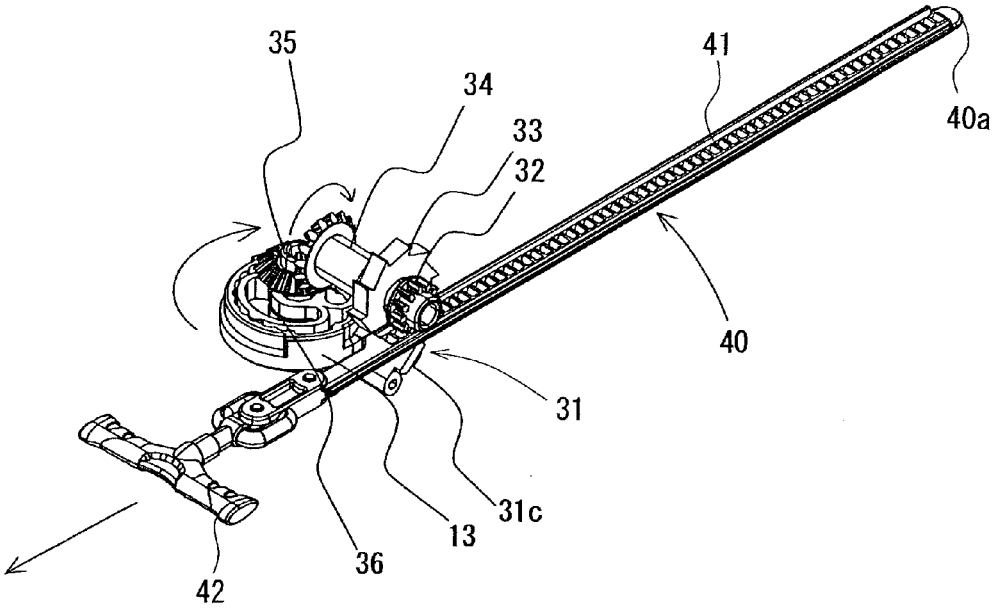
FIGS. 8A and 8B are illustrations showing the actuation of the rotating mechanism when the rack belt is pulled out in the states shown in FIG. 2A and FIG. 5A, respectively.

The rotating mechanism 30 of the spinner 10 according to the present embodiment is constructed as described above. As shown in FIG. 8A, when the rack belt 40 inserted through the insertion hole 21 is pulled out, the pinion gear 32 is rotated and then the rotational force of the pinion gear 32 is transmitted through the ratchet gear 33 and the first bevel gear 34 to the second bevel gear 35 and then to the clutch 36 while the rotating direction is being converted by the second bevel gear 35 to an orthogonal direction, whereby the toy top mounting part 13 is rotated.

Therefore, after the toy top 50 is mounted on the toy top mounting part 13 and the rack belt 40 is inserted through the insertion hole 21 of the spinner main body 1, when the rack belt 40 is vigorously pulled out, the rotating mechanism 30 in the spinner main body 11 is actuated to rotate the toy top mounting part 13, to thereby launch the toy top 50 having a rotational force imparted thereto.

When the rack belt 40 is inserted through the insertion hole 21 of the spinner main body 11, the lock member 31 is pushed away by a back surface (a surface opposite from that on a side where the rack gear 41 is provided) of the rack belt 40 contacting the belt contacting part 31*c* and is moved to a retracted position where the ratchet pawl 31*b* is not engaged with the ratchet gear 33. Therefore, in the state in which the rack belt 40 is inserted through the insertion hole 21, the regulation of the rotation of the ratchet gear 33 is released, thereby allowing the rotating mechanism 30 to be actuated. When the rack belt 40 has been pulled out, however, the rack belt 40 and the belt contacting part 31*c* no longer contact each other. Therefore, by an urging force of the biasing means not shown, the ratchet pawl 31*b* of the lock member 31 is engaged with the ratchet gear 33, thereby preventing the rotation of the ratchet gear 33. For this reason, when the rack belt 40 inserted through the insertion hole 21 is swiftly pulled out, the toy top mounting part 13 that has been vigorously rotating until it is pulled out instantaneously stops. At this time, even when the rotation of the toy top mounting part 13 stops, the toy top 50 rotates due to an inertial force. Therefore the engaging claws 15 are disengaged from the engaging holes 51 of the toy top 50, so that the toy top 50 falls down while vigorously rotating.

Figure 8B:
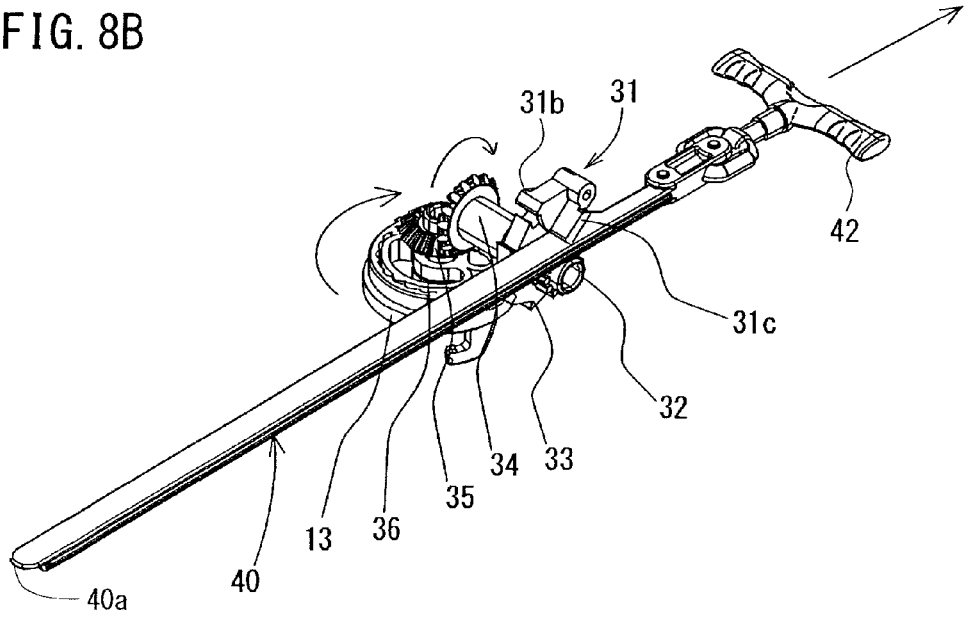

The lock member 31 functions not only to stop the rotation of the toy top mounting part 13 by engagement of the lock member 31 with the ratchet gear 33 as described above, but also to determine a direction in which the rack belt 40 is inserted with respect to the insertion hole 21. That is, as shown in FIGS. 8A and 8B, when the rack belt 40 is inserted in the insertion hole 21 in a direction in which the belt contacting part 31*c* of the lock member 31 is pushed away, the rack belt 40 can be inserted as the belt contacting part 31*c* of the lock member 31 is being pushed away. When the rack belt 40 is inserted from a reverse side of the insertion hole 21, however, a tip 40*a* of the rack belt 40 abuts on a rear surface of the belt contacting part 31*c* of the lock member 31 to press the ratchet pawl 31*b* onto the ratchet gear 33, and therefore the rack belt 40 cannot be inserted any further. Thus the direction in which the rack belt 40 is inserted is determined, and thus the rotating direction of the rotating mechanism 30 can always be determined to be a fixed direction.

The reason for this is as follows. FIG. 8A shows the state in which the rotary section 20 is positioned for a right-handed person. In this case, as shown in FIG. 2A, the base section 12 is placed on the left, and the rotary section 20 is on the right. A player holds the base section 12 with his left hand and pulls out the rack belt 40 with his right hand to rotate the toy top 50. In this case, the toy top 50 rotates in a clockwise direction as viewed from above.

On the other hand, FIG. 8B shows the state in which the rotary section 20 is rotated to be positioned for a left-handed person. In this case, as shown in FIG. 5A, the base section 12 is placed on the right, and the rotary section 20 is on the left. A player holds the base section 12 with his right hand and pulls out the rack belt 40 with his left hand to rotate the toy top 50. Also in this case, the toy top 50 rotates in a clockwise direction as viewed from above.

Also as shown in FIG. 5B, even when the rotary section 20 is rotated approximately 90 degrees from the state of FIG. 2A and the rack belt 40 is pulled out upwardly, the toy top 50 rotates in a clockwise direction as viewed from above, although the rotation mechanism of the spinner main body 1 is not particularly shown.

Thus the spinner 10 according to the present embodiment is constructed in such a manner that the rotation of the toy top 50 (the toy top mounting part 13) is not influenced no matter how the rotary section 20 is rotated with respect to the base section 12.

As described in the foregoing, according to the spinner 10 of the present embodiment, the rotary section 20 is rotated with respect to the base section 12 so that the direction in which the insertion hole 21 extends can be changed. Therefore the direction in which the rack belt 40 is inserted and pulled out can be set as desired, and the rack belt 40 can be pulled out in a direction in which the user can easily perform a pulling operation.

For example, as shown in FIG. 5B, in the case where the rotary section 20 is rotated with respect to the base section 12 so that the rack belt 40 can be inserted and pulled out in the same direction as the rotation axis of the toy top mounting part 13, even when the rack belt 40 is strongly pulled out to cause an unintentional movement of the spinner main body 11, the moving direction of the spinner main body 11 is identical to the direction of the axis of rotation of the toy top 50 (that is, a vertical direction). Therefore, the launching position of the toy top 50 in a horizontal direction with respect to a playing surface or ground is not influenced, and thus the launching position of the toy top 50 can be easily set and held in place.

Also, even when the rotary section 20 is rotated so that the rack belt 40 can be inserted and pulled out in a direction orthogonal to the axis of rotation of the toy top mounting part 13, the rotary section 20 can be rotated in such a manner that the base section 12 is located on either the right or the left side of the rotary section 20. Therefore the spinner 10 of the present embodiment is suitable for both right-handed and left-handed players.

In the present embodiment, the rotation range of the rotary section 20 is 180 degrees. This range is determined based on the minimum range required for rotary section 20 to be used by both right-handed and left-handed players. In both the state in which the rotary section 20 is positioned at one rotation limit shown in FIG. 2A and the state in which the rotary section 20 is rotated to be positioned at the other rotation limit shown in FIG. 5A, the direction in which the rack belt 40 is inserted and pulled out can be set to be a direction orthogonal to the rotation axis of the toy top mounting part 13. Thus the position of the insertion hole 21 can be easily changed according to whether the player is right-handed or left-handed. The rotation range of the rotary section 20 is not restricted to approximately 180 degrees. For example, the rotary section 20 may be constructed to be rotatable 360 degrees. Thus the flexibility of rotation of the rotary section 20 can be increased.

What is claimed is:

1. A spinner for a toy top for launching the toy top while imparting a rotational force to the toy top, comprising:

an elongated plate-shaped rack belt having a rack gear formed thereon; and a spinner main body having a top surface, a bottom surface, and an insertion hole therein through which the rack belt is inserted, the spinner main body including a toy top mounting part to rotate about a first axis of rotation provided on the bottom surface for mounting the toy top thereon and a rotating mechanism provided inside the spinner main body, the rotating mechanism being actuated by pulling out the rack belt to impart a rotational force to the toy top mounting part, wherein the spinner main body is so constructed that the rack belt can be inserted in and pulled out from the insertion hole in a same direction as a direction of the first axis of rotation.

2. The spinner for a toy top according to claim 1, wherein the spinner main body includes a base section in which the toy top mounting part is arranged and a rotary section rotatably provided with respect to the base section, and the insertion hole is formed in the rotary section so that a direction in which the insertion hole extends can be changed by rotating the rotary section with respect to the base section.

3. The spinner for a toy top according to claim 2, wherein the rotary section can be rotated up to 360°.

4. The spinner for a toy top according to claim 2, wherein the rotating mechanism includes a pinion gear that engages with the rack gear of the rack belt and that is rotated about a second axis of rotation by pulling out the rack belt, and a gear mechanism that transmits a rotation of the pinion gear to the toy top mounting part to rotate the toy top mounting part about the first axis of rotation orthogonal to the second axis of rotation.

5. The spinner for a toy top according to claim 3, wherein the rotating mechanism includes a pinion gear that engages with the rack gear of the rack belt and that is rotated about a second axis of rotation by pulling out the rack belt, and a gear mechanism that transmits a rotation of the pinion gear to the toy top mounting part to rotate the toy top mounting part about the first axis of rotation orthogonal to the second axis of rotation.

6. The spinner for a toy top according to claim 4, wherein the gear mechanism includes a first bevel gear that is coupled to the pinion gear and that is integrally rotatable with the pinion gear about the second axis of rotation, and a second bevel gear that meshes with the first bevel gear and that is coupled to the toy top mounting part so as to rotate integrally with the toy top mounting part about the first axis of rotation.

7. The spinner for a toy top according to claim 5, wherein the gear mechanism includes a first bevel gear that is coupled to the pinion gear and that is integrally rotatable with the pinion gear about the second axis of rotation, and a second bevel gear that meshes with the first bevel gear and that is coupled to the toy top mounting part so as to rotate integrally with the toy top mounting part about the first axis of rotation.

8. The spinner for a toy top according to claim 4, wherein the rotary section has a rotational center that coincides with the second axis of rotation.

9. The spinner for a toy top according to claim 6, wherein the rotary section has a rotational center that coincides with the second axis of rotation.

10. The spinner for a toy top according to claim 6, wherein the pinion gear is arranged inside the rotary section, and the first bevel gear and the second bevel gear are arranged inside the base section.

11. The spinner for a toy top according to claim 7, wherein the pinion gear is arranged inside the rotary section, and the first bevel gear and the second bevel gear are arranged inside the base section.

12. The spinner for a toy top according to claim 4, wherein the rotating mechanism includes a ratchet gear that is coupled to the pinion gear and that is integrally rotatable with the pinion gear about the second axis of rotation, and a lock member engaging with the ratchet gear to regulate a rotation of the ratchet gear, the lock member being pushed away by the rack belt inserted through the insertion hole to be disengaged from the ratchet gear.

13. The spinner for a toy top according to claim 6, wherein the rotating mechanism includes a ratchet gear that is coupled to the pinion gear and that is integrally rotatable with the pinion gear about the second axis of rotation, and a lock member engaging with the ratchet gear to regulate a rotation of the ratchet gear, the lock member being pushed away by the rack belt inserted through the insertion hole to be disengaged from the ratchet gear.

14. A spinner for imparting a rotational force to a toy top, comprising:

a rack gear; and a spinner main body having a top surface, a bottom surface, a first axis of rotation and a second axis of rotation substantially perpendicular to the first axis, and an insertion hole to receive the rack gear, the spinner main body including an external toy top mounting part to rotate about the first axis of rotation on the bottom surface for receiving the toy top and an internal rotating mechanism, the rotating mechanism being rotated by pulling out the rack gear which rotates the toy top mounting part, wherein the rack gear can be inserted in and pulled out from the insertion hole along an axis substantially parallel to the first axis of rotation.

15. The spinner according to claim 14, wherein the spinner main body includes a base section in which the toy top mounting part is arranged and a rotary section rotatably provided with respect to the base section, and the insertion hole is formed in the rotary section so that a direction in which the insertion hole extends can be changed by rotating the rotary section with respect to the base section.

16. The spinner according to claim 15, wherein the rotary section can be rotated up to 360 degrees.

17. The spinner according to claim 15, wherein the rotating mechanism includes a pinion gear that engages with the rack gear and that is rotated about the second axis of rotation by pulling out the rack gear, and a gear mechanism that transmits a rotation of the pinion gear to the toy top mounting part to rotate the toy top mounting part about the first axis of rotation orthogonal to the second axis of rotation.

18. The spinner according to claim 16, wherein the rotating mechanism includes a pinion gear that engages with the rack gear and that is rotated about the second axis of rotation by pulling out the rack gear, and a gear mechanism that transmits a rotation of the pinion gear to the toy top mounting part to rotate the toy top mounting part about the first axis of rotation orthogonal to the second axis of rotation.

19. The spinner according to claim 17, wherein the gear mechanism includes a first bevel gear that is connected to and integrally rotatable with the pinion gear about the second axis of rotation, and a second bevel gear that meshes with the first bevel gear and that is coupled to the toy top mounting part so as to rotate integrally with the toy top mounting part about the first axis of rotation.

20. The spinner according to claim 18, wherein the gear mechanism includes a first bevel gear that is connected to the pinion gear and integrally rotatable with the pinion gear about the second axis of rotation, and a second bevel gear that meshes with the first bevel gear and that is coupled to the toy top mounting part so as to rotate integrally with the toy top mounting part about the first axis of rotation.

21. The spinner according to claim 17, wherein the rotary section has a rotational center that coincides with the second axis of rotation.

22. The spinner for a toy top according to claim 19, wherein the rotary section has a rotational center that coincides with the second axis of rotation.

23. The spinner according to claim 19, wherein the pinion gear is arranged inside the rotary section, and the first bevel gear and the second bevel gear are arranged inside the base section.

24. The spinner according to claim 20, wherein the pinion gear is arranged inside the rotary section, and the first bevel gear and the second bevel gear are arranged inside the base section.

25. The spinner according to claim 17, wherein the rotating mechanism includes a ratchet gear that is coupled to the pinion gear and that is integrally rotatable with the pinion gear about the second axis of rotation, and a lock member engaging the ratchet gear to regulate a rotation of the ratchet gear, the lock member being disengaged from the ratchet gear when the rack gear is inserted through the insertion hole.

26. The spinner according to claim 19, wherein the rotating mechanism includes a ratchet gear that is coupled to the pinion gear and that is integrally rotatable with the pinion gear about the second axis of rotation, and a lock member engaging the ratchet gear to regulate a rotation of the ratchet gear, the lock member being disengaged from the ratchet gear when the rack gear is inserted through the insertion hole.

27. A spinner for imparting a rotational force to a toy top, comprising:

a rack gear; and a spinner main body having a first axis of rotation and a second axis of rotation substantially perpendicular to the first axis of rotation and an insertion hole therein to receive the rack gear, the spinner main body including an external toy top mounting part rotatable about the first axis of rotation on a bottom surface of the spinner main body for receiving the toy top and an internal rotating mechanism, the rotating mechanism being rotated by pulling out the rack gear which rotates the toy top mounting part, wherein the spinner main body includes a base section in which the toy top mounting part is arranged and a rotary section provided to be rotatable about the second axis, and the insertion hole is formed in the rotary section so that a direction in which the insertion hole extends can be changed to be substantially parallel to the first axis of rotation by rotating the rotary section with respect to the base section about the second axis of rotation.

28. The spinner according to claim 27, wherein the rotary section can be rotated up to 360 degrees.

29. The spinner according to claim 27, wherein the rotating mechanism includes a pinion gear that engages with the rack gear and that is rotated about the second axis of rotation by pulling out the rack gear, and a gear mechanism that transmits a rotation of the pinion gear to the toy top mounting part to rotate the toy top mounting part about the first axis of rotation orthogonal to the second axis of rotation.

30. The spinner according to claim 29, wherein the gear mechanism includes a first bevel gear that is connected to and integrally rotatable with the pinion gear about the second axis of rotation, and a second bevel gear that meshes with the first bevel gear and that is coupled to the toy top mounting part so as to rotate integrally with the toy top mounting part about the first axis of rotation.

31. The spinner according to claim 30, wherein the pinion gear is arranged inside the rotary section, and the first bevel gear and the second bevel gear are arranged inside the base section.

32. The spinner according to claim 30, wherein the rotating mechanism includes a ratchet gear that is coupled to the pinion gear and that is integrally rotatable with the pinion gear about the second axis of rotation, and a lock member engaging the ratchet gear to regulate a rotation of the ratchet gear, the lock member being disengaged from the ratchet gear when the rack gear is inserted through the insertion hole.

33. The spinner according to claim 27, wherein the toy top mounting part is oriented horizontally and the rack gear is oriented vertically.

34. The spinner according to claim 32, wherein the pinion gear, the ratchet gear and the first bevel gear are co-axial with the second axis of rotation, wherein a clutch is positioned between the second bevel gear and the toy top mounting part, and wherein the second bevel gear, the clutch and the toy top mounting part are co-axial with the first axis of rotation.

* * * * *